US005342234A

United States Patent [19]

Bloom

[11] Patent Number: 5,342,234

[45] Date of Patent: Aug. 30, 1994

[54] FREE-STANDING STUFFED TOY

[75] Inventor: Stuart J. Bloom, Lexington, Mass.

[73] Assignee: Pockets of Learning, Sudbury, Mass.

[21] Appl. No.: 90,249

[22] Filed: Jul. 9, 1993

Related U.S. Application Data

[63] Continuation of Ser. No. 875,225, Apr. 28, 1992, abandoned.

[51] Int. Cl.[5] ..... A63H 3/14

[52] U.S. Cl. ..... 446/327; 446/268

[58] Field of Search ..... 446/327, 329, 328, 268, 446/369, 387, 98, 100, 80, 488, 388, 478, 476; 40/539, 152.1

[56] References Cited

U.S. PATENT DOCUMENTS 547,223 10/1895 McCalmont ..... 446/387
1,516,159 11/1924 Southworth et al. ..... 40/539
2,944,368 7/1960 O'Brian et al. ..... 446/100 X
3,521,399 7/1970 Deal ..... 446/329
3,855,730 12/1974 Baer ..... 446/369
4,925,423 5/1990 Miller et al. ..... 446/387 X
5,092,555 3/1992 Best et al. ..... 40/152.1 X

*Primary Examiner*—Mickey Yu
*Attorney, Agent, or Firm*—Hamilton, Brook, Smith & Reynolds

[57] ABSTRACT

The two-dimensional stuffed toy has a stiff cloth pocket sewn on its back. The opening of the pocket is approximately level with the base of the stuffed figure, such that, when the pocket is pulled away from the stuffed toy it provides a stable support to keep the toy upright when placed on a level surface. By inserting one's finger into the pocket, the stuffed toy may also be used as a finger puppet.

6 Claims, 3 Drawing Sheets

FREE-STANDING STUFFED TOY

This is a continuation of co-pending application Ser. No. 07/875,225 filed on Apr. 28, 1992, abandoned.

BACKGROUND OF THE INVENTION

Stuffed toys ape known in the art, wherein two layers of fabric ape sewn together at their peripheries and stuffed with fiber batting to form soft toys that are substantially two-dimensional, in that they have a smooth front side and a smooth back side. As the sewn edges may be irregularly shaped, such toys may represent a wide variety of objects, including people and animals. Commonly, such two-dimensional stuffed toys are combined with three-dimensional fabric toys such as houses, vehicles and the like, known as "soft-sculptures", For example, a cloth play-house may be combined with two-dimensional stuffed dolls, which a child may use to "play house".

SUMMARY OF THE INVENTION

While such two-dimensional stuffed toys are easy to manufacture, they are limited in their functionality, in that their construction prevents them from standing freely on an edge. Thus, for example, figures of people or animals must lie on one of their flat surfaces and cannot stand erect.

In accordance with the present invention, a two-dimensional stuffed toy is provided with a stiff pocket sewn to its back. The pocket is made of a stiff fabric, or of cloth combined with a stiffening material, such as "Pellon ®". The opening of pocket is made almost level with the bottom edge of the stuffed toy, such that when pulled away from the back of the stuffed toy, the pocket provides a stable support which enables the toy to be free-standing. The pocket also provides an enclosure for one's finger, which enables the stuffed toy to serve as a finger puppet.

When made in the form of a person or animal, such two-dimensional stuffed toys are provided with additional play value as compared to ordinary stuffed toys, as they may be placed play settings in an upright position, and may be used as finger puppets.

In a preferred embodiment, the pocket is triangular, with two sides sewn to the back side of the stuffed toy, and the third side open at the base of the toy and almost level with the base of the toy. The included angle of the sewn sides is made smaller than the included angle of the pocket before sewing, so that the pocket may be extended from the surface of the toy. The pocket may be folded along the bisector of the angle included between its sewn sides, and again along a bisector of the angle formed between the first fold line and one of the sewn sides so that the pocket may lie flat against the back of the toy.

DETAILED DESCRIPTION OF THE PREFERRED EMBODIMENT

Figure 1:
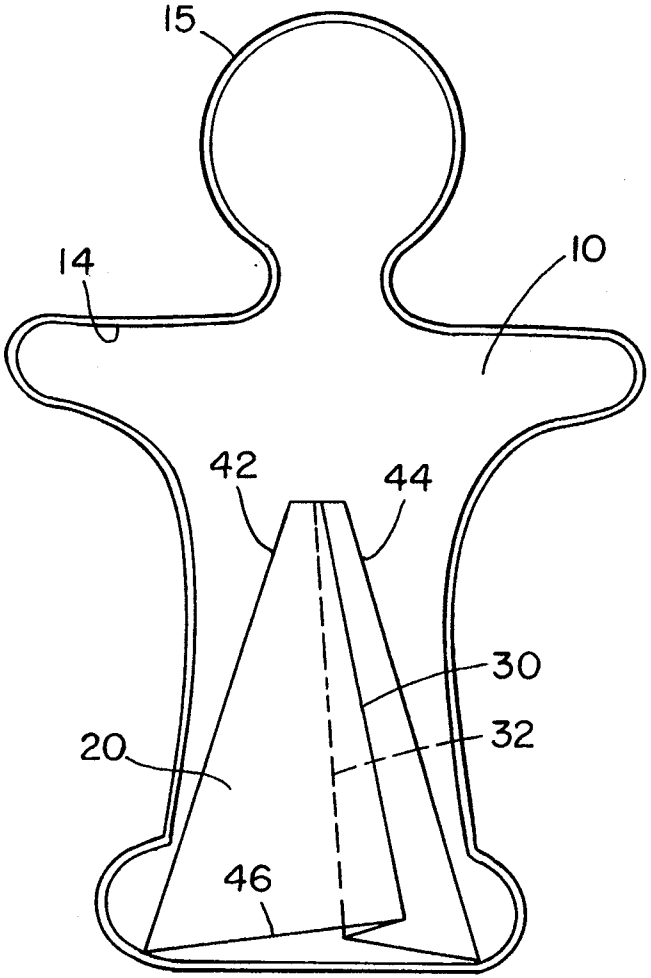
FIG. 1 is a rear view of the invention showing the pocket folded against the back of the stuffed toy.
Figure 4:
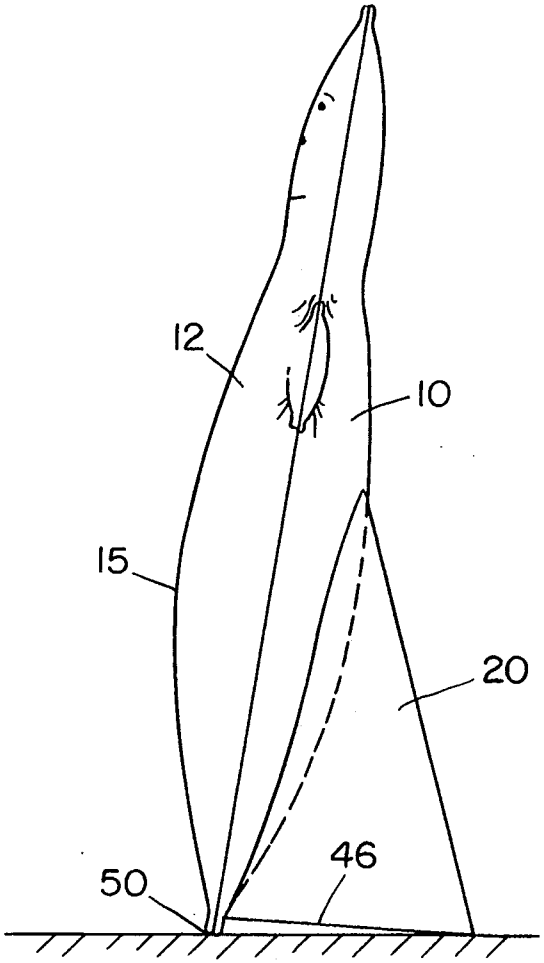
FIG. 4 is a side view of the invention showing the pocket extended away from the back of the surfed toy.

The stuffed toy is shown from the rear in FIG. 1 and from the side in FIG. 4. Stuffed toy 15 is formed from front fabric 12 and rear fabric 10, which are sewn together along edge sewing line 14 and stuffed with a soft fiber filling (not shown). Fabric pocket 20 is sewn onto rear fabric 10 along sides 42 and 44, leaving side 46 open at the base. In a preferred embodiment, pocket 20 is folded along lines 30 and 32 so that it can lie flat over rear fabric 10.

Figure 3:
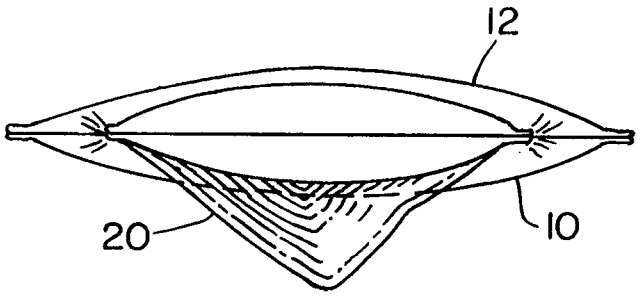
FIG. 3 is a bottom plan view of the invention showing the pocket extended away from the back of the stuffed toy.
Figure 2:
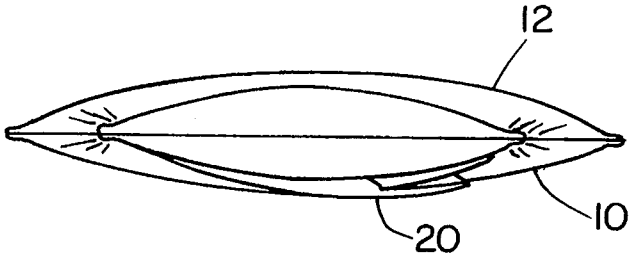
FIG. 2 is a bottom plan view of the invention showing the pocket folded against the back of the stuffed toy.

FIG. 2 and FIG. 3 show bottom views of stuffed toy 15, with pocket 20 folded flat against rear fabric 10 in FIG. 2 and extended away from rear fabric 10 in FIG. 3. Pocket 20 is made of a stiff fabric, or if made of a limp fabric, may be backed with a layer of stiff fabric, such as Pellon ®polyester fiber backing to furnish stiffness.

FIG. 4 shows a side view of stuffed toy 15 having front fabric 12 and rear fabric 10, with pocket 20 extended to form a support between base 50 of stuffed toy 15 and bottom edge 46 of pocket 20. Bottom edge 46 is positioned slightly above base 50 so that stuffed toy 15 will lean backwards onto pocket 20 when standing.

Figure 5A:
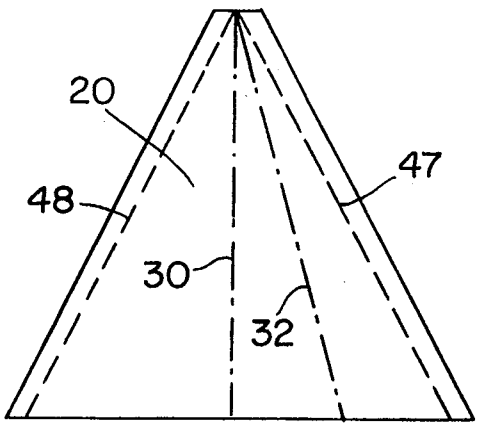
FIG. 5A is view of the pocket fabric before it is sewn to the toy.
Figure 5B:
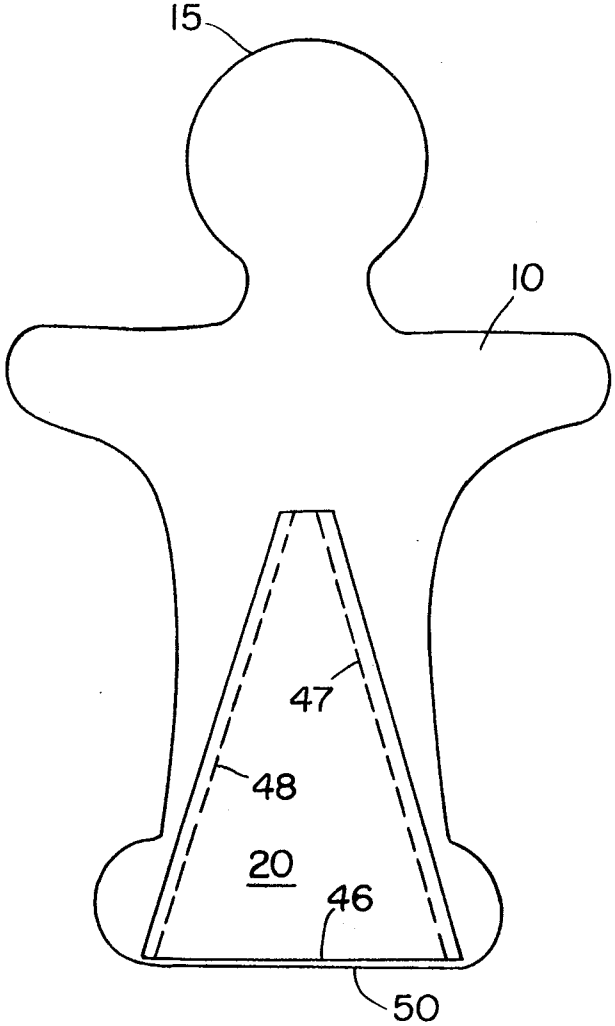
FIG. 5B is rear view of the invention showing the pocket sewn to the toy.

FIG. 5A shows pocket 20 fully extended before being sewn onto stuffed toy 15, and FIG. 5B shows the pocket after it is sewn onto stuffed toy 15. Before sewing, the included angle between sewing lines 47 and 48 is larger than after pocket 20 is sewn onto rear fabric 10, so that pocket 20 may be extended away from the surface of rear fabric 10.

Figure 6:
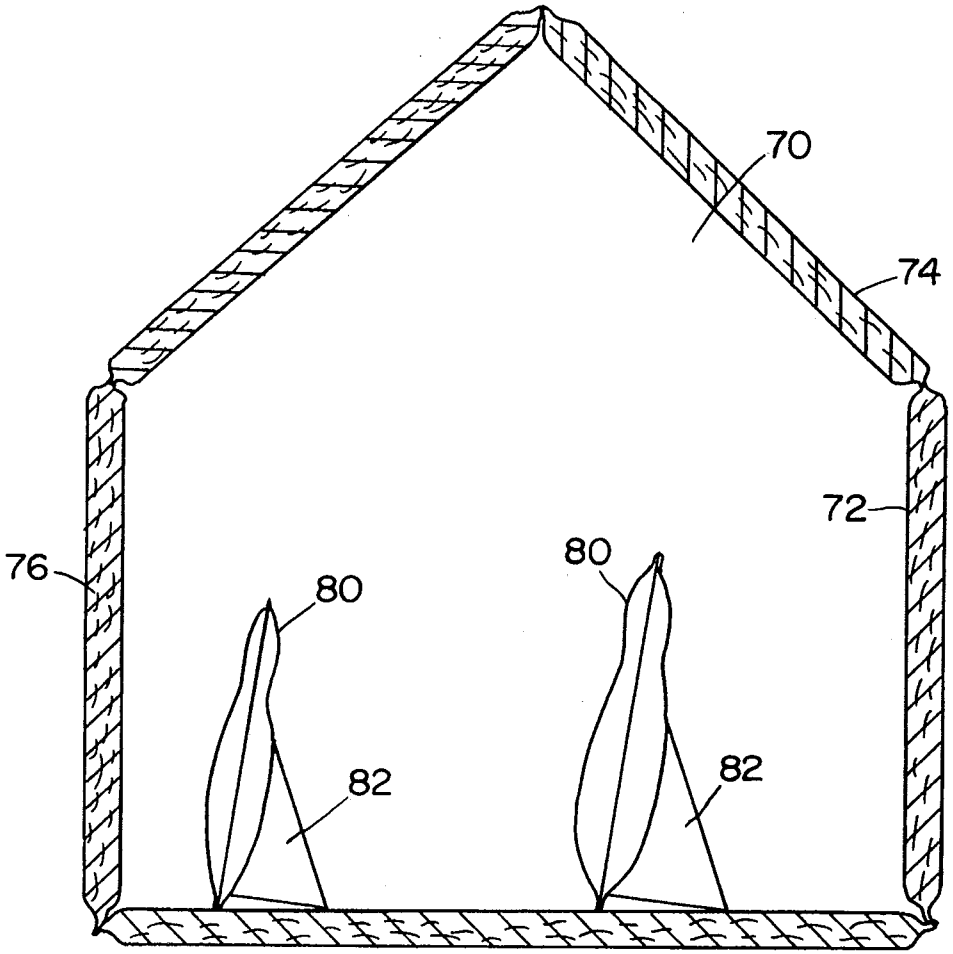
FIG. 6 is a sectional side view of a soft-sculptured house with two stuffed figures according to the present invention.

FIG. 6 shows soft-sculptured house 70 constructed of inner fabric 72 and outer fabric 74 containing soft filling 76. Stuffed toys 80 may be supported by pockets 82 to be free standing, thereby providing a more realistic setting than if toys 80 could only lie in a horizontal position or be leaned against a support.

While the invention has been particularly shown and described with reference to a preferred embodiment thereof, it will be understood to those skilled in the art that various changes in form and details may be made therein without departing from the spirit and scope of the invention as defined by the appended claims:

I claim:

1. A stuffed figure comprising:

a front surface;

a rear surface opposite the front surface;

a base; and a fabric pocket sewn to said rear surface, the pocket substantially enclosing a region between the pocket and the rear surface except for an opening located near the base of said stuffed figure, the pocket being extendable from said rear surface, such that the extended pocket supports the stuffed figure in an upright position, and such that the pocket also provides an enclosure between the pocket and the rear surface for a person's finger enabling the stuffed figure to serve as a finger puppet, wherein said pocket has two sides sewn to said rear surface at a first acute angle relative to each other such that an opening is formed between the sewn sides, said pocket being folded along a first bisecting line approximately bisecting the first acute angle formed by said sewn sides, and again folded along a second bisecting line, the fold along the second bisecting line approximately bisecting a second acute angle formed between said first bisecting line and one of said sewn sides.

2. A stuffed figure according to claim 1, further comprising a first fabric piece and a second fabric piece of similar outline, both the first and second fabric pieces being sewn together along their common edges about the front and rear surfaces and stuffed with a soft material.

3. A stuffed figure according to claim 1 wherein the first angle is formed between two sewn edges of the stuffed figure and both the first and second angles being acute.

4. A stuffed figure according to claim 1 wherein said pocket is made of a stiff fabric.

5. A stuffed figure according to claim 1 wherein said pocket is comprised of two fabric layers, wherein a first fabric layer closest to said stuffed figure is a stiff fabric and a second fabric layer outermost from said stuffed figure is a limp fabric.

6. A fabric toy comprising:

a soft-sculptured housing made of sewn fabric filled with a soft batting; and two or more stuffed figures positioned about the soft-sculptured housing, each stuffed figure comprising a front surface, a rear surface opposite the front surface, a base and a fabric pocket sewn to said rear surface, the pocket substantially enclosing a region between the pocket and the rear surface except for an opening located near the base of said stuffed figure, the pocket being extendable from said rear surface, such that the extended pocket supports the stuffed figure in an upright position, and such that the pocket also provides an enclosure between the pocket and the rear surface for a person's finger enabling the stuffed figure to serve as a finger puppet, wherein said pocket has two sides sewn to said rear surface at a first acute angle relative to each other such that an opening is formed between the sewn sides, said pocket being folded along a first bisecting line approximately bisecting the first acute angle formed by said sewn sides, and again folded along a second bisecting line, the fold along the second bisecting line approximately bisecting a second acute angle formed between said first bisecting line and one of said sewn sides.

* * * * *